US005348384A

United States Patent [19]

Hull et al.

[11] Patent Number: 5,348,384

[45] Date of Patent: Sep. 20, 1994

[54] APPARATUS FOR SUPPORTING A TITLE COUNTER CAP

[76] Inventors: Harold L. Hull, 401 Canyon Way #43, Sparks, Nev. 89434; Eugene M. Peterson, 1405 Pass Dr., Reno, Nev. 89509

[21] Appl. No.: 999,364

[22] Filed: Dec. 31, 1992

[51] Int. Cl.[5] ..... A47B 96/18

[52] U.S. Cl. ..... 312/140.3; 108/27; 52/287.1

[58] Field of Search ..... 312/140.3; 108/27; 52/254, 255, 287.1, 288, 716.3, 716.4

[56] References Cited

U.S. PATENT DOCUMENTS

| | | | |
|---|---|---|---|
| 3,309,832 | 3/1967 | Filsinger | 52/287 X |
| 3,953,268 | 4/1976 | Dillon | 52/287 X |
| 5,060,438 | 10/1991 | O'Rourke . | |
| 5,073,430 | 12/1991 | Aidan . | |

*Primary Examiner*—Brian K. Green

[57] ABSTRACT

Disclosed is a corner tile elongated support strip in the form of a sandwich with the center portion of the sandwich being made of a high density small bead foam with the outer sides of the sandwich being made of high impact extruded plastic. The center portion provides a stress barrier to keep stresses generated in the support structure from reaching the corner trim tile to reduce its tendency to crack.

6 Claims, 2 Drawing Sheets

APPARATUS FOR SUPPORTING A TITLE COUNTER CAP

FIELD OF THE INVENTION

The present invention relates to the tiling of counter tops or cabinets but more particularly to support of the tile cap that forms the corner at the front of the tile cap.

BACKGROUND OF THE INVENTION

It is known in the tiling field that when tiling counter tops, cabinets or the like, many times cracking of the tile cap is incurred. Therefore it is desirous to provide a method and/or apparatus which eliminates or highly reduces the occurrence of the above mentioned problem.

In the past attempts have been made to reduce the likelihood of cracking the adhesive and/or the tile cap. Such as U.S. Pat. No. 5,060,438, wherein they provide a method and apparatus which includes a channel shaped cap support strip for a cap strip of a tiled counter top which is formed with a plurality of projecting tongues that are embedded within the adhesive that overlies the horizontal surface of the counter, with the body of the cap support strip channel being nailed to the vertical surface of the front of the counter. The tongues, embedded in the adhesive that holds the tile in pace, hold the upper part of the cap support strip securely tied to the counter top and "in theory" helps to prevent cracking of the tile caps, however in practise this and other prior art apparatus's have proved un-satisfactory due to the traveling stress in both walls and floors which is transferred to the tile cap.

Traveling stress in both walls and floors have been recognized and addressed in the prior art in the ceramic tile trade since its beginning. Most workman in the trade today are cognizant of the various causes and conditions that create this problem but are helpless to minimize or alleviate them.

In relatively recent times traveling stress in the rail of mud-set countertops, has been an increasing problem. The inventors of the present invention have consulted with every knowledgeable source immediately available, and the best answer found was both vague and ambiguous. This is to that the consensus of opinion is that stress is caused by movement. That kind of answer gives one little satisfaction when standing and looking at a countertop with stress-cracked tile running half way around it, as if a pair of giant hands had torn those tiles apart as easily as a person tears a piece of newspaper.

With this in mind, we have analyzed the possible sources of movement starting at the bottom. First, there is the compaction of the soil under a post footing. The moisture in the soil could dry out with a possibility of a 1/32" movement downward. Second, the redwood block under the post sitting on the footing could compress 1/32". Third, the post itself could shrink 1/32". Fourth, the beam on the post could shrink 1/32". This next item has a potential for being the worst culprit of all the others put together, that being $\frac{3}{4}$" flakeboard sub-flooring. The reason for this is, even though bonding resins are waterproof, the wood fibers are not. When left out in the weather before the roof is on, they will expand $\frac{1}{4}$". This doesn't affect its structural integrity, however, covering it with underlayment and setting cabinets on it is tantamount to setting cabinets over carpet pad and in a worst scenario, the potential for movement is up to $\frac{3}{8}$".

In the prior art, most kitchen cabinets in the past were custom fabricated as a single unit built from solid $\frac{3}{4}$" wood or $\frac{3}{4}$" plywood, while today's cabinets are primarily modular units and the only things that are $\frac{3}{4}$" solid wood are face frames and doors. The side panels are $\frac{3}{8}$" particleboard and the back panels are $\frac{1}{4}$" masonite. The bottoms and shelving are $\frac{1}{4}$" masonite, veneered. In the past, face frames were nailed and glued and had corner and angle blocking. Most modular units today are glued and might have a few pins or staples in them. One can readily see that these newer cabinets do not contribute to a stable base for the mud countertops. The tile manual recommends slash cutting in $\frac{3}{4}$" plywood tops or 1'×6" boards placed at $\frac{1}{4}$ intervals. However, in the opinion of many workman it can be argued that a solid $\frac{3}{4}$" plywood top contributes more to the structural integrity of the whole, especially on the front of the cabinet because of the fact there is a 4" toe kick at the base of the cabinet. This means the face of the cabinet is cantilevered and is getting all its support from the side panels. This is especially true on overhanging countertops with a serving area. In the latter, it is imperative that, in order to get any support at all, the korbels be aligned over the modular unit side panel joints.

Two other points must be considered when discussing particleboard: first, the fact that particleboard resin used in the manufacturing process contains formaldehyde as a drying agent, and a 4'×8' sheet of particleboard can shrink in size up to $\frac{1}{8}$" during the curing. It also takes up moisture very readily under extremely damp conditions. In either case, there is a possibility of popping its own glue joints. Second, there is a tendency to buckle under stress. Now that the movement that can transpire from the ground to the underlayment and the variables involved in the cabinet itself are understood, next comes the big question! How does all this downward vertical movement relate to stress in the rail?

This can best be answered by visualizing a sectional view of a cabinet with a tile countertop. The first thing that happens is a downward movement of the face of the cabinet caused by one or more of the aforementioned possibilities. At this point the stress is felt only on the face of the cabinet, but at the same time, is magnified by the fact that the pivot point for the stress is at the base of the cabinet where it meets the toe kick, which is secured to the floor. There is no downward stress on the back of the cabinet, as it is firmly secured to the outside wall, where it remains stable.

Now visualize the rough top, which is essentially an elongated rectangular member that is firmly secured to the back wall of the cabinet and the hardwood face frame. The stress in now transferred to the rough top, and by its downward movement, changes our rough top into a parallelogram when viewed from a level plane with the pressure point being the top front corner, which essentially acts as a wedge. At this point, one must bear in mind that the mud-set ceramic countertop is a rigid, monolithic unit without tolerance for flexibility. At this point the stress is telegraphed through the convention prior art A-metal and the mud backing on the rail apron. Next, a basic law of physics comes into play, the law of compound leverage. The stress is transferred vertically to the top of the rail seeking the weakest point to expend its energies and is on the tail side of the rail. The origin of this stress usually starts in the middle of an area that has the most severe movement.

Then it goes trough the aforementioned steps and travels in both directions of the rail until its energies have been released.

It is therefore desirable to provide means to remove and keep the stress generated by any one or any combination of the above described stresses from reaching the tile corner cap to reduce its potential to crack, and it is this problem which the present invention addresses.

SUMMARY OF THE INVENTION

It is therefore a primary object to provide a method and apparatus to isolate the stresses created in the structures of the cabinets and their foundations and to keep them from reaching the tile corner cap to minimize cracking.

It is another object to replace the conventional A-metal screed strip with what we shall call and refer to as a P-strip.

It is still another object to provide the P-strip in a form which will perform as a mud screed in lieu of the A-strip.

Still another important object is to construct the P-strip in two units consisting of a first main body screed, which may be made of high impact plastic, and a second isolation barrier member which in the preferred embodiment, is made of a high density small bead foam.

Yet another object in a second embodiment, is to provide a pre-assembled P-strip which can be nailed through the outer plastic strip through a hole larger than the nail head with the nail head being set all the way to the inner elongated hole of the inner plastic strip.

Yet another object is to make the main body screed in the form of an elongated strip that in cross section has a rib along its upper edge in the shape of an off-centered upside-down teardrop so that the back surface of the P-strip is flat and on its lower edge has a lip orientated away from its flat backside.

Still another object is to form the isolation barrier second member in the form of an elongated strip with one of its sides conforming in size and shape to mate with the main body screed on the side opposite the flat side.

A further object is to have on the mating side of the second member a thin, smooth plastic coating over which there is a peel-and-stick coating.

Still another object is to provide on the outer surface opposite the peel-and-stick surface a hard plastic surface, which in the preferred embodiment, has a radius on the top and bottom corners.

Another object is to provide multiple nail slots in the first main body screed.

Other objects and advantages will become obvious when taken into consideration with the following specifications and drawings.

DETAILED DESCRIPTION OF THE DRAWINGS

Figure 1:
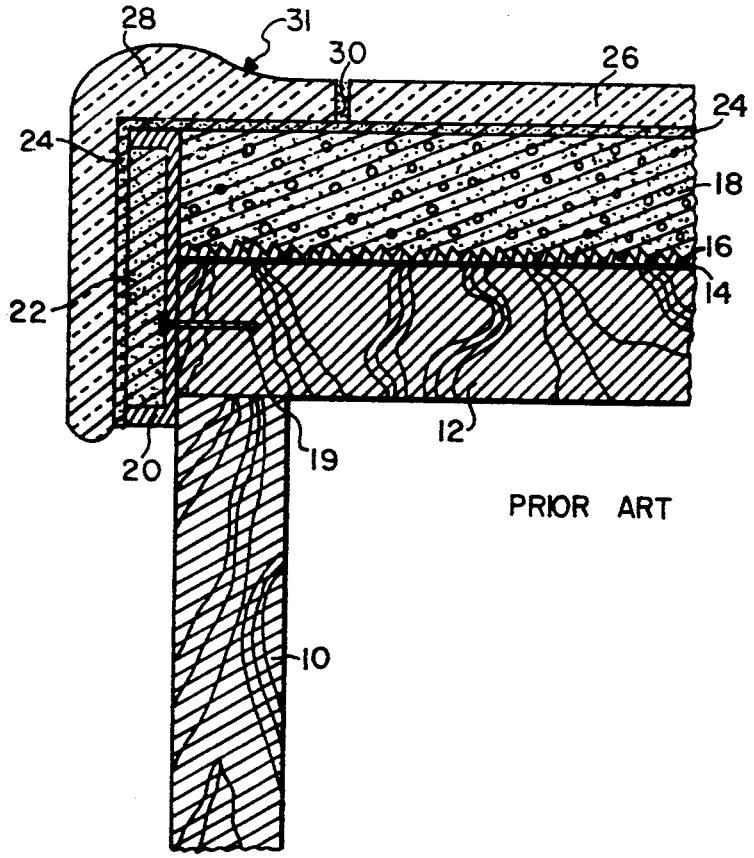
FIG. 1, is a sectional view of a typical prior art installation.

Referring now in detail to the drawings wherein like characters refer to like elements throughout the various drawings. In FIG. 1, a typical prior art installation is shown wherein 10 is a wooden upright support such as a cabinet face frame with 12 being a wooden base and 14 being a membrane such as roofing felt or polyethylene film while 16 is a metal lath on which the mortar base bed 18 is spread with 20 being a typical punched metal strip attached to the front edge of the cabinet by multiple nails 19 and used as a screed and support for the countertop trim 28 and is filled with wall mortar 22. 24 is a bond coat which is spread on the mortar base 18 and wall mortar 22 which have been allowed to cure. Now the tile 26 and the tile trim 28 are set on the bond coat 24 and grout 30 applied.

It will be seen that any downward or other movements as previously described of the wooden structures involved can only transfer the stress created to the tile 28, causing it to fracture generally in the area of arrow 31.

Figure 2:
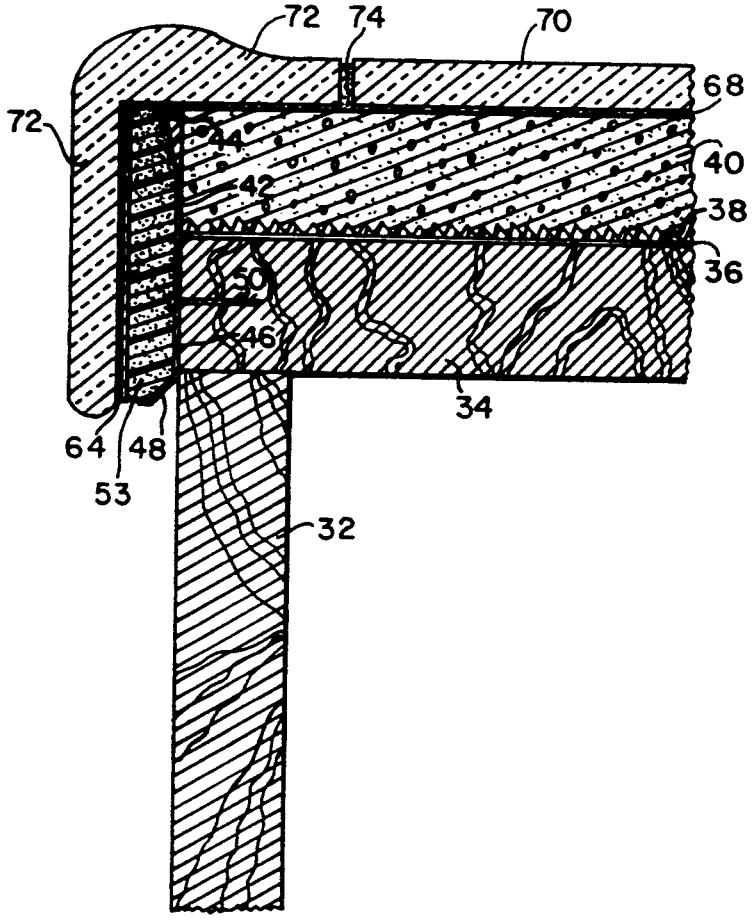
PRIOR ART FIG 2
FIG. 2, is a sectional view of our present invention.
Figure 3:
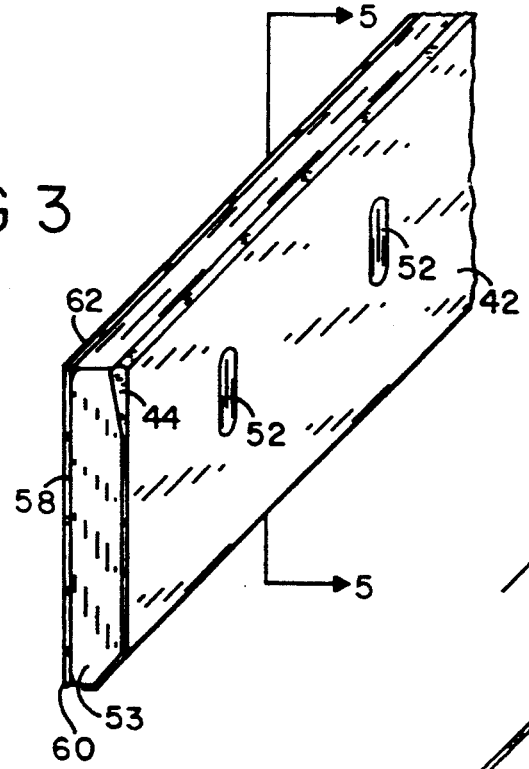
FIG. 3, is a perspective view of the present invention.
Figure 4:
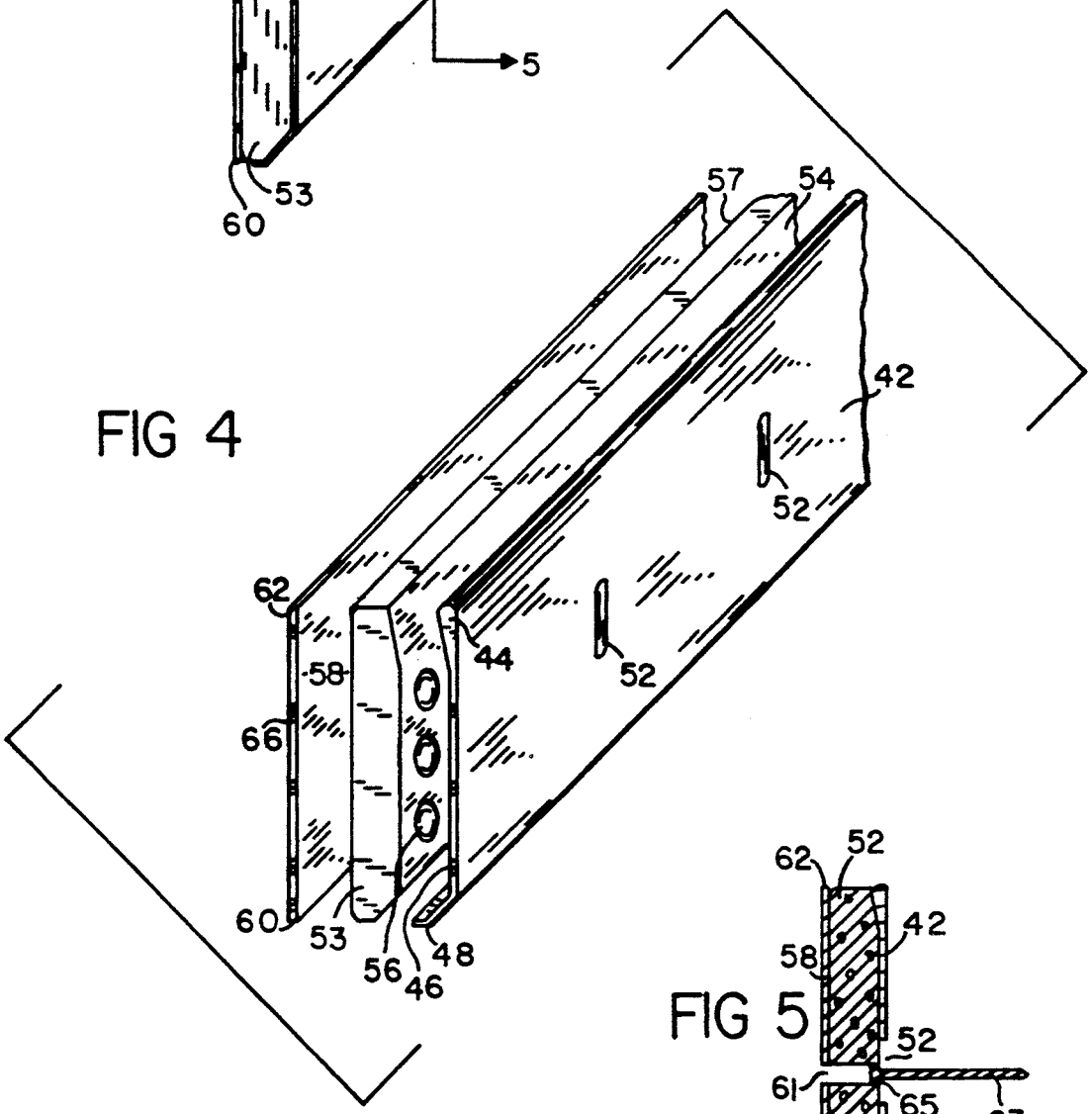
FIG. 4, is an exploded perspective view of the present invention.

Referring now to FIG. 2, a typical installation of the present invention is shown, wherein 32 is a wooden upright support such as a cabinet face frame with 34 being a wooden base and 36 being a membrane such as roofing felt or polyethylene film while 38 is a metal lath on which the mortar base bed 40 is spread. 42 is substantially an elongated strip which is a first unit of our new invention which we choose to call a "P-strip", and is a first main body screed which is made in the preferred embodiment, of a high-impact extruded plastic with a rib 44 along its upper edge in the shape of an off-centered upside-down teardrop so that the back surface 46 is flat while the lower edge has a lip 48 which is orientated away from the flat surface 46. The lip 48 includes a first and a second section. The first section is oriented at a substantially 45 degree angle relative to the first side of the first member. The second section is oriented at a substantially 45 degree angle relative to the first section. The second section is oriented at a substantially 90 degree angle relative to the first side of the first member. The first main body screed 42 is affixed to the cabinet structure 34 by nails 50 thru nailing slots 52 which are more clearly shown in FIGS. 3 and 4, respectively.

A second unit of our new invention, which again we refer to as a "P-strip", is substantially an elongated strip 53 which in the preferred embodiment, is formed of a high-density small bead foam with one of its sides 54 conforming in size and shape to mate with the contoured side 46 of the main body screed 42.

The side 54 of the second unit 53 is also covered by a thin, smooth plastic coating (not shown) over which there is a peel-and-stick coating, (not shown) which when removed uncovers the adhesive which, in the preferred embodiment, is in the form of dots 56.

The outer side 57 or opposite side of second unit 53 is affixed such as by an adhesive to a hard plastic strip 58 forming a high-impact surface and in the preferred embodiment, is formed with a radius on its upper and lower edges 60 and 62, respectively.

An adhesive 64 is now applied to the outer side 66 of the hard plastic strip 58 and the bond coat 68 is applied and tile 70 and tile trim-cap 72 are set in place and grouted at joint 74.

Figure 5:
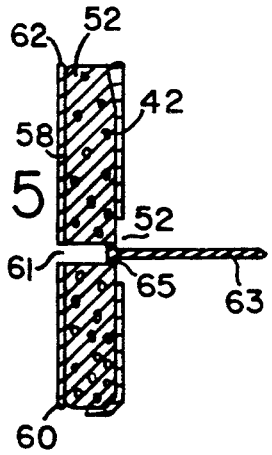
FIG. 5, is a section taken at 5—5 of FIG. 3.

In a second embodiment the P-strip is pre-assembled and bonded together in a sandwich by adhesive with the outer plastic strip 58 more clearly shown in FIG. 5 having a larger hole 61 thru which a nail 63 may be driven including the head 65, with the head 65 being countersunk to the nailing slot 52.

It will now be seen that we have provided a new, unusual apparatus and method to isolate the aforementioned stresses described in the above prior art and substantially prevent these stresses from reaching the tile trim-cap, thus reducing their chances of cracking.

It will also be seen that we have eliminated the prior art A-strip and the need to fill the prior art A-strip with mortar thus reducing costs.

We have also provided a resilient support surface for the tile trim-cap which absorbs the impact of a blow and substantially reduces its tendency to crack.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by Letters Patent is:

1. In a tile covered structure having a horizontal and vertical surface meeting to form a structure corner and having a plurality of tiles covering at least part of said horizontal surface, and a plurality of corner tiles each formed of substantially horizontal and vertical leg sections positioned at said corner, said tiles being secured to said structure by adhesive material between the tiles and structure, the improvement comprising: a corner tile support strip attached between the vertical surface and the vertical leg sections of said corner tiles, said corner tile support strip having first, second and third members, said first member being a substantially elongated strip having an upper edge, said elongated strip forming a main body screed, a lower edge and first and second sides, said first member being formed of a substantially rigid material, said first and second edges of said first member being parallel, said upper edge of said first member forming a rib which in cross section, is in a shape of an off-centered, upside-down teardrop, said lower edge having a lip, said lip orientated away from said first side, said first side being flat, said second side having a contour formed by said rib of said upper edge and said lip of said lower edge, said first member having multiple vertical slots, said slots being of a size and shape to accept fastening means, said second member being a substantially elongated strip having a thickness greater than said first member, said second member being made of a porous non-rigid material, said second member having upper and lower edges and first and second sides, said upper edge terminating no further than said upper edge of said first member, a portion of said lower edge terminating within confines of said lip of said lower edge, said first side of said second member conforming in size and shape to said contour of said second side of said first member, adhesive means between said first side of said second member and said second side of said first member, said third member being a substantially elongated strip having upper and lower parallel edges, said third member having first and second sides, said first side having means to be bonded to said second side of said second member, said second side of said third member being flat whereby, a sandwiched structure is formed which performs as an isolation barrier to prevent stresses from said structure to transfer to said corner tiles.

2. The corner tile support strip of claim 1 in which said first and third members are made of high-impact extruded plastic.

3. The corner tile support strip of claim 1 in which said second member is made of high density small bead foam.

4. The corner tile support strip of claim 1 in which said lip includes a first section oriented at a substantially 45 degree angle relative to the first side of said first member, a second section oriented at a substantially 45 degree angle relative to said first section, and said second section oriented at a substantially 90 degree angle relative to the first side of said first member.

5. The corner tile support strip of claim 1 in which said means to bond said first side of said third member to said second side of said second member is an adhesive.

6. The corner tile support strip of claim 1 in which an outer corner of said third member has a radius.

* * * * *